US007461513B2

(12) United States Patent
Broerman et al.

(10) Patent No.: US 7,461,513 B2
(45) Date of Patent: Dec. 9, 2008

(54) COOLING SYSTEM

(75) Inventors: Steven E. Broerman, Cincinnati, OH (US); David Kremp, Cincinnati, OH (US)

(73) Assignee: Illinois Tool Works Inc., Glenview, IL (US)

( * ) Notice: Subject to any disclaimer, the term of this patent is extended or adjusted under 35 U.S.C. 154(b) by 370 days.

(21) Appl. No.: 11/370,367

(22) Filed: Mar. 8, 2006

(65) Prior Publication Data

US 2007/0209370 A1 Sep. 13, 2007

(51) Int. Cl.
*F25B 9/02* (2006.01)
*F25D 23/12* (2006.01)
*F25D 19/00* (2006.01)

(52) U.S. Cl. ..... 62/5; 62/259.2; 62/296

(58) Field of Classification Search ..... 62/5, 62/296, 259.2
See application file for complete search history.

(56) References Cited

U.S. PATENT DOCUMENTS 2,737,028 A * 3/1956 Machlanski ..... 62/5
3,144,754 A * 8/1964 Tilden ..... 62/5
3,277,238 A * 10/1966 Sharp et al. ..... 348/83
3,654,768 A 4/1972 Inglis et al.
3,740,832 A * 6/1973 Toepper ..... 29/508
4,240,261 A * 12/1980 Inglis ..... 62/5
4,333,754 A * 6/1982 Peter ..... 62/5
5,009,043 A * 4/1991 Kurrasch ..... 52/145
5,010,736 A * 4/1991 York et al. ..... 62/5
6,205,796 B1 * 3/2001 Chu et al. ..... 62/94
6,868,938 B2 * 3/2005 Lecours ..... 181/231

* cited by examiner

*Primary Examiner*—William C Doerrler
(74) *Attorney, Agent, or Firm*—Paul Donovan

(57) ABSTRACT

A cooling system configured to cool an interior of an enclosure includes a cabinet, and a vortex tube secured within the cabinet. The cabinet defines a venting chamber. The vortex tube includes a hot pipe within the venting chamber, and a cool gas delivery pipe extending outwardly from the cabinet. The cool gas delivery pipe is configured to deliver cold gas to the interior of the enclosure. A dampening sleeve may be secured around at least a portion of the hot pipe, such that the dampening sleeve dampens noise produced by the vortex tube. Additionally, at least one dampening sheet may line at least a portion of the interior and exterior surfaces of the cabinet.

29 Claims, 8 Drawing Sheets

COOLING SYSTEM

FIELD OF THE INVENTION

Embodiments of the present invention generally relate to cooling system, and more particularly to a cooling system that includes a vortex tube.

BACKGROUND OF THE INVENTION

Various enclosures, whether they are sealed, substantially sealed, or unsealed to their surrounding environment are cooled. Typically, the enclosures house various components that may be adversely affected by temperatures elevated above room or ambient temperature. In the case of enclosures containing electrical equipment, heat buildup within the enclosures can damage the components and/or cause safety hazards, for example, fires. Many of these enclosures, particularly those that are substantially or completely sealed, are not easily ventilated.

U.S. Pat. No. 3,654,768, entitled "Vortex Tube Cooling System" (the "'768 patent") which is hereby incorporated by reference in its entirety, discloses a cooling system particularly adapted for various types of enclosures, including sealed, substantially sealed, and unsealed enclosures. The system disclosed in the '768 patent is a vortex tube cooling system that includes a mechanical thermostat operable to actuate a valve that controls the flow of compressed air to the vortex tube, which, in turn, controls the temperature inside the enclosure. The embodiments described in the '768 patent provide a relatively small, thermostatically controlled cooling system that is easy to install and requires relatively low maintenance, when compared to conventional "Freon type" air conditioners. The systems disclosed in the '768 patent, however, provide a cooling system that produces high noise levels. In particular, the noise created by the high velocity spinning air within a vortex tube may be objectionable to some. Such noise may annoy, irritate, or even cause discomfort to, an operator of the enclosure, or those in close proximity to the enclosure.

Previous attempts at minimizing noises produced by the vortex tube include attaching mufflers to the hot and cold ends of the vortex tube. The mufflers, however, do not substantially reduce the noise levels a significant amount.

Thus, a need exists for compact cooling system that is easy to install and produces low noise levels.

SUMMARY OF THE INVENTION

Certain embodiments of the present invention provide a cooling system configured to cool an interior of an enclosure that includes a cabinet defining a venting chamber, and a vortex tube including a hot pipe within the venting chamber, and a cool gas delivery pipe extending outwardly from the cabinet. The cool gas delivery pipe is configured to deliver cool gas (such as air) to the interior of the enclosure.

A dampening sleeve may be secured around at least a portion of the hot pipe. The dampening sleeve may be formed of rubber and acts to absorb, dampen, or otherwise reduce noise produced by the vortex tube.

At least one dampening sheet may also line at least a portion of the cabinet, whether within the interior chamber, on the exterior of the cabinet, or both. The dampening sheet may be formed of open cell foam and acts to absorb, dampen, or otherwise reduce noise produced by the vortex tube. Additionally, flexible dampening rods, which also may be formed of open cell foam, may be disposed within the venting chamber to further dampen noise produced by the vortex tube.

Certain embodiments of the present invention also provide a bleed air hole configured to be in fluid communication with the interior of the enclosure and a source of air. The bleed air hole is operable to allow air to pass into the enclosure to maintain a pressure differential between the interior of the enclosure and an outside environment. The pressure differential prevents debris from infiltrating into the enclosure even when the vortex tube is deactivated.

Figure 1:
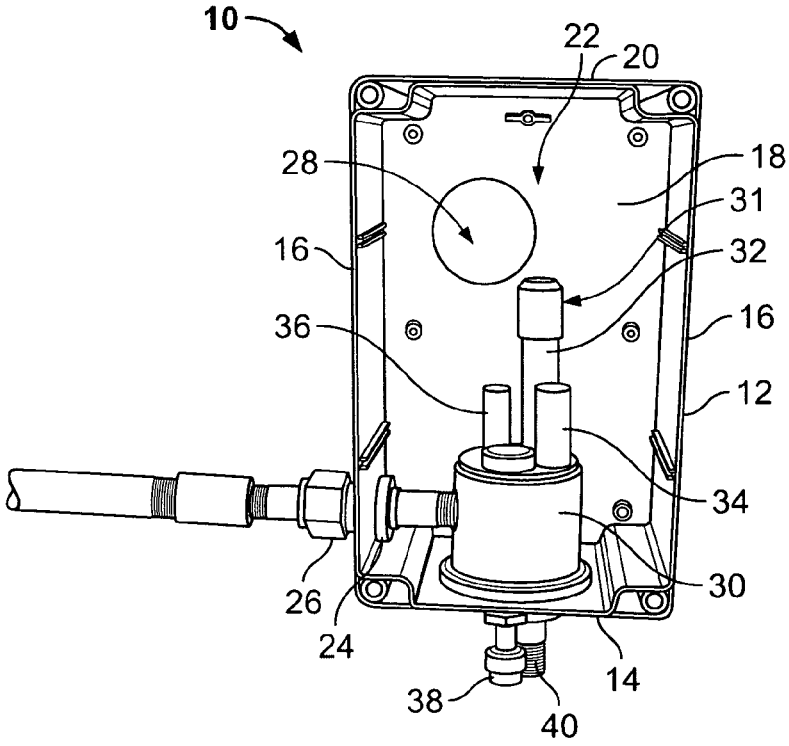
FIG. 1 illustrates a front perspective interior view of a cooling system according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates a front perspective interior view of a cooling system 10 according to an embodiment of the present invention. The cooling system 10 includes a cabinet 12, which may be formed of polycarbonate, that includes a base 14 integrally formed with lateral walls 16, and a rear wall 18. The lateral walls 16 and rear wall 18 are, in turn, integrally formed with an upper wall 20. The base 14, the lateral walls 16, the rear wall 18, and the upper wall 20 define a venting chamber 22 therebetween. A removable front cover (not shown in FIG. 1) is secured to edges of the base 14, lateral walls 16, and upper wall 20 to enclose the venting chamber 22.

A gas inlet passage 24 is formed through one of the lateral walls 16. The gas inlet passage 24 is configured to receive and retain a gas delivery tube, pipe, duct, or the like 26 of a gas (such as air) compression system (not shown in FIG. 1). The gas inlet passage 24 may securely retain the gas delivery pipe 26 through a threadable or compression type connection.

A venting hole 28 is formed through the rear wall 18. The venting hole 28 allows gas, such as air, within the venting chamber 22 to pass out of the cooling system 10.

A cylindrical main heat conduction housing 30 may be securely retained within a hole (not shown) formed in the base 14 through a variety of connections. For example, the cylindrical main housing 30 may be threadably secured within the hole, or the cylindrical main housing 30 may be bonded to the base 14. The main heat conduction housing 30 extends into the venting chamber 22 and supports a vortex tube 31 that includes a hot tube, pipe, duct or the like 32, and cool gas delivery pipe 40 extending through the base 14 of the cabinet 12. The main heat conduction housing 30 also supports two upwardly extending vent tubes, pipes, ducts, or the like 34 and 36. A thermostat 38 and the cool gas delivery pipe 40 extend from the main heat conduction housing 30 through the base 14. The hot pipe 32 may be one end of the vortex tube 31, while the cool gas delivery pipe 40 may be the opposite end of the vortex tube 31.

The main heat conduction housing 30 is operable to produce cool gas, such as air, that is delivered out of the cooling system 10 via the cool gas delivery pipe 40. The thermostat 38 is configured to detect temperatures within an enclosure (not shown). The main heat conduction housing 30 operates to produce cool air based on temperature readings of the thermostat 38 that is delivered through the gas delivery pipe 40. As a byproduct of this heat conduction process, however, the main heat conduction housing 30 also produces heated gas, such as air, within the venting chamber 22. The heated gas is vented through the venting hole 28.

Figure 2:
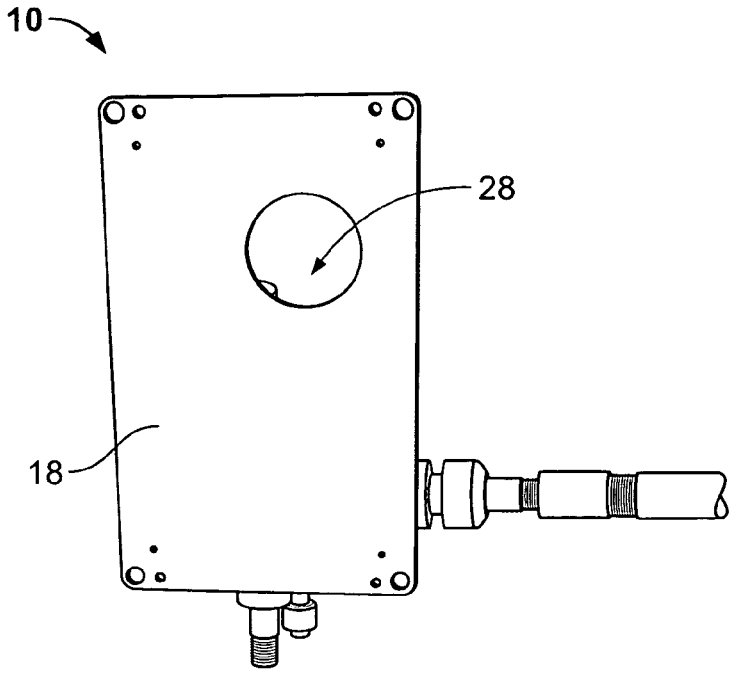
FIG. 2 illustrates a rear perspective view of a cooling system according to an embodiment of the present invention.

FIG. 2 illustrates a rear perspective view of the cooling system 10. As shown in FIG. 2, the venting hole 28 provides a passage for gas within the venting chamber 22 (shown in FIG. 1) to pass out of the cooling system 10.

Figure 3:
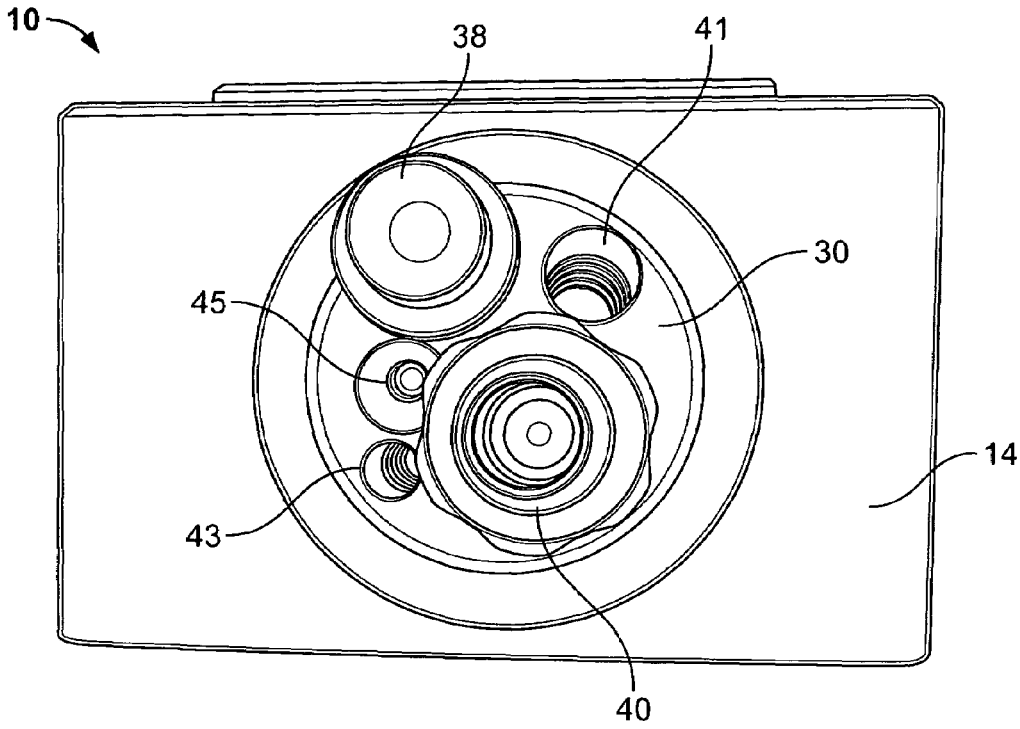
FIG. 3 illustrates a bottom perspective view of a cooling system according to an embodiment of the present invention.

FIG. 3 illustrates a bottom perspective view of the cooling system 10. As shown in FIG. 3, the main heat conduction housing 30 is secured within the base 14. The thermostat 38 and the cool gas delivery pipe 40 of the vortex tube extend downwardly from the main heat conduction housing 30. A vent hole 41 is formed through the main heat conduction housing 30 and is in fluid communication with the vent pipe 34 (shown in FIG. 1). Similarly, a vent hole 43 is also formed through the main conduction housing 30 and is in fluid communication with the vent pipe 36 (shown in FIG. 1). The vent holes 41 and 43 allow gas, such as air, to pass into the vent pipes 34 and 36, into the venting chamber 22 (shown in FIG. 1), and eventually out of the cooling system 10 via the venting hole 28 (shown in FIGS. 1 and 2). A bleed air hole 45 may also be formed through the main heat conduction housing 30 and is configured to allow gas to pass from the main heat conduction housing 30 out of the cooling system 10 into an enclosure. As discussed below, the bleed air hole 45 may be used to maintain a pressure differential between an interior of an enclosure and its outside environment to keep the enclosure interior clean.

Figure 4:
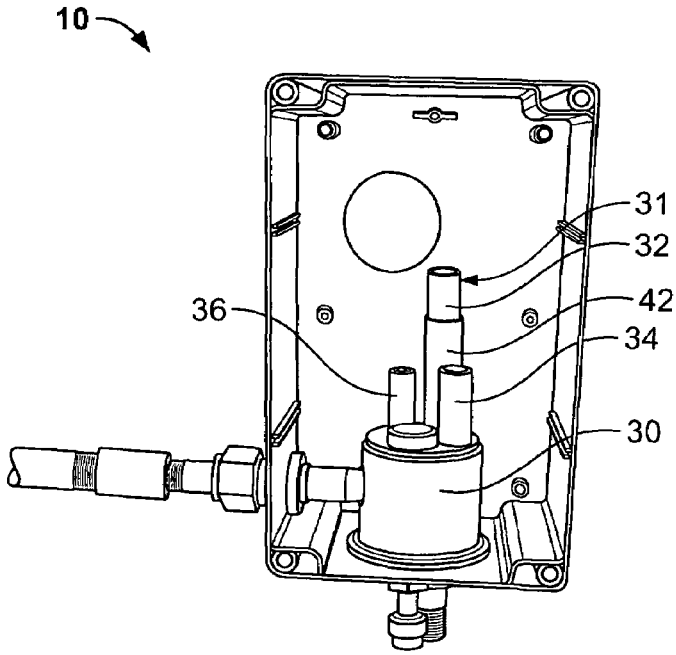
FIG. 4 illustrates a front perspective interior view of a cooling system including a dampening sleeve over a hot tube according to an embodiment of the present invention.

FIG. 4 illustrates a front perspective interior view of the cooling system 10 in which a dampening sleeve 42 is disposed over the hot pipe 32. The hot pipe 32 of the vortex tube is enclosed inside of the dampening sleeve 42, which may be an elastomeric or rubber hose that surrounds a substantial portion of the hot pipe 32. The dampening sleeve 42 may reduce noise produced within and/or by the vortex tube by dampening high frequency vibrations and resulting noise from the hot pipe 32. In any event, it has been found that disposing the dampening sleeve 42 around the hot pipe 32 dampens, or otherwise reduces, the amount of noise produced by the vortex tube.

Figure 5:
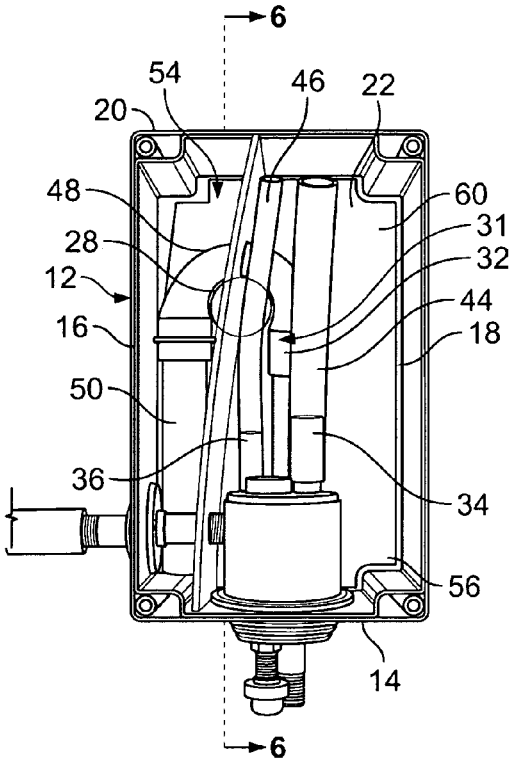
FIG. 5 illustrates a front perspective interior view of a cooling system according to an embodiment of the present invention.

FIG. 5 illustrates a front perspective interior view of the cooling system 10. As shown in FIG. 5, a hollow, flexible, open-ended tube 44 is secured to the vent pipe 34, while a hollow, flexible open-ended tube 46 is secured to the vent pipe 36. The tubes 44 and 46 may be vinyl tubes. Gas from the vent pipes 34 and 36 is passed into the tubes 44 and 46, respectively, and out into the venting chamber 22 through the open ends of the tubes 44 and 46.

Hot exhaust from the hot pipe 32 is routed via a hollow, flexible tube 48 (such as a vinyl tube) to a sealed porous plastic tubing 50. As shown in FIG. 5, the tube 48 may be bent to form a semicircular joint between the hot pipe 32 and the porous plastic tubing 50. The plastic tubing 50 is secured within the venting chamber 22. The plastic tubing 50 may be secured to the base 14 of the cabinet 12. Because the tubing 50 is porous, hot exhaust gases may pass therethrough and out of the vent opening 28. The porous plastic tubing 50 also serves as a muffler to further abate the noise caused by the vortex tube that is transmitted through the hot pipe 32.

A baffle 52 may be secured within the venting chamber 22. The baffle 52 may be positioned between the main heat conduction housing 30 and the plastic tubing 50 at a lower end, while being angled toward the tubes 44 and 46 at an upper end, such that the venting hole 28 may be divided into a hot exhaust portion and a cool exhaust portion. Hot exhaust gas from the hot pipe 32 that passes out of the porous plastic tubing 50 vents out of the cooling system 10 through the hot exhaust portion of the venting hole 28, while cool exhaust gases from the vent pipes 34 and 36 vent out of the cooling system 10 through the cool exhaust portion of the venting hole 28. The baffle 52 may be plastic, rubber, vinyl, or the like, and serves to segregate the venting chamber 22 into two separate areas—a hot exhaust area 54 and a cool air area 56. As such, hot and cool gases within the venting chamber 22 are separated from one another. The baffle 52 ensures that hot and cool air flows within the venting chamber 22 are separate from one another so that the pressure created by the hot exhaust gas does not overpower the vented cool air.

An open cell foam sheet 60 lines the rear wall 18 of the cabinet 12 within the venting chamber 22. Additionally, open cell foam may also line the base 14, lateral walls 16, and upper wall 20 of the cabinet 12 within the venting chamber 22. Further, sheets of open cell foam may also line an interior surface of a cover (not shown) of the cabinet 12. The open cell foam sheet 60, and any other cell foam within the venting cabinet 22, further dampens noise produced by the cooling system 10, while also allowing exhaust gas to flow through. Optionally, open cell foam sheets may line outer surfaces of the cabinet 12 in addition to, or in lieu of, interior surfaces of the cabinet 12 within the venting chamber 22. Alternatively, instead of open cell foam, the sheet 60 may be another dampening material, such as rubber, plastic, or the like.

Figure 6:
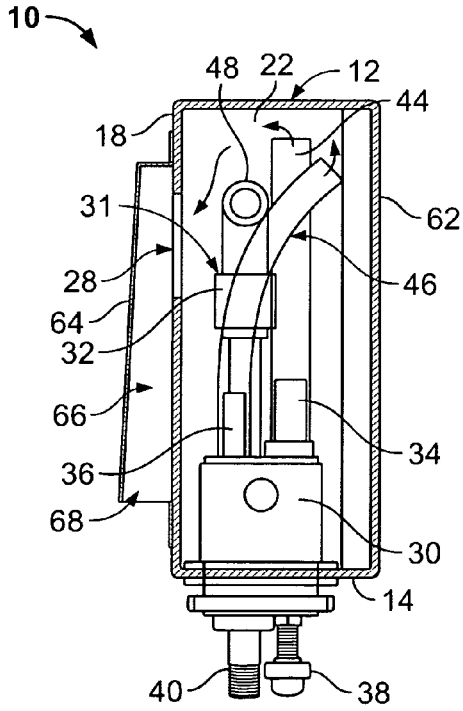
FIG. 6 illustrates a lateral cross-sectional view of a cooling system through line 6-6 of FIG. 5 according to an embodiment of the present invention.

FIG. 6 illustrates a lateral cross-sectional view of the cooling system 10 through line 6-6 of FIG. 5. As shown in FIG. 6, a cover 62 is secured over a front of the cabinet 12. Additionally, a shroud 64 is mounted over the outside of the rear wall 18. An exhaust path 66 is defined between an interior of the shroud 64 and an outer surface of the rear wall 18. As such, exhaust gases may pass out of the venting chamber 22 through the venting hole 28. The exhaust gases are then directed downwardly by the shroud 64 through an exhaust outlet 68 at the bottom of the shroud 64. For example, relatively cooler exhaust gases that pass from the vent pipes 34 and 36 out through the flexible tubes 44 and 46, respectively, may pass through the venting hole 28 and out of the cooling system 10 through the exhaust outlet 68. Similarly, hot exhaust gas that passes from the hot pipe 32 through the plastic tubing 50 (shown in FIG. 5) may pass through the pores of the plastic tubing 50, and out of the cooling system 10 through the venting hole 28. The hot exhaust gas may then pass out of the cooling system 10 through the exhaust outlet 68.

Figure 7:
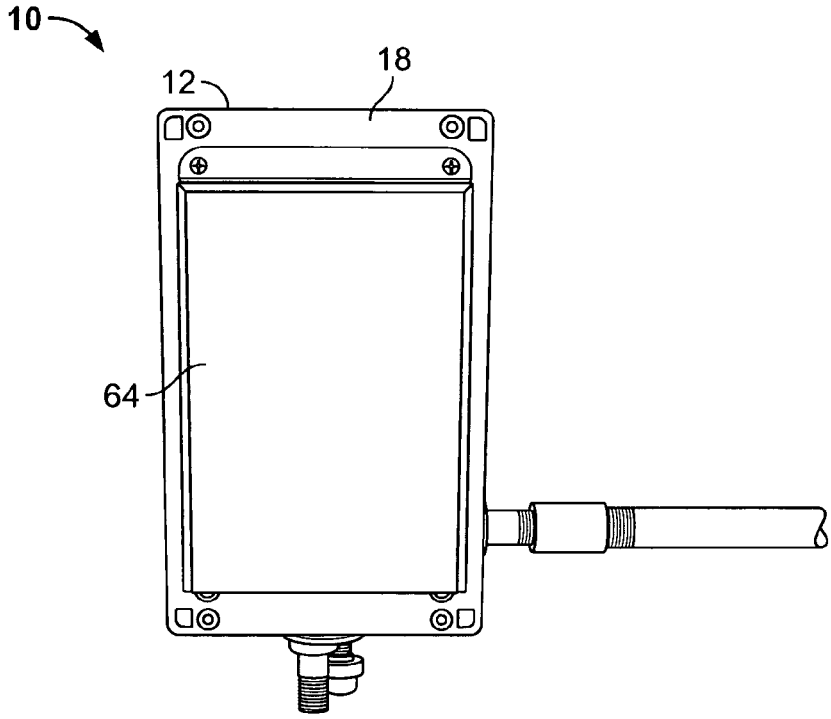
FIG. 7 illustrates a rear perspective view of a cooling system including a shroud over a rear venting wall according to an embodiment of the present invention.

FIG. 7 illustrates a rear perspective view of the cooling system with the shroud 64 over the rear wall 18. As shown in FIG. 7, the shroud 64 may cover a substantial portion of the rear wall 18.

Figure 8:
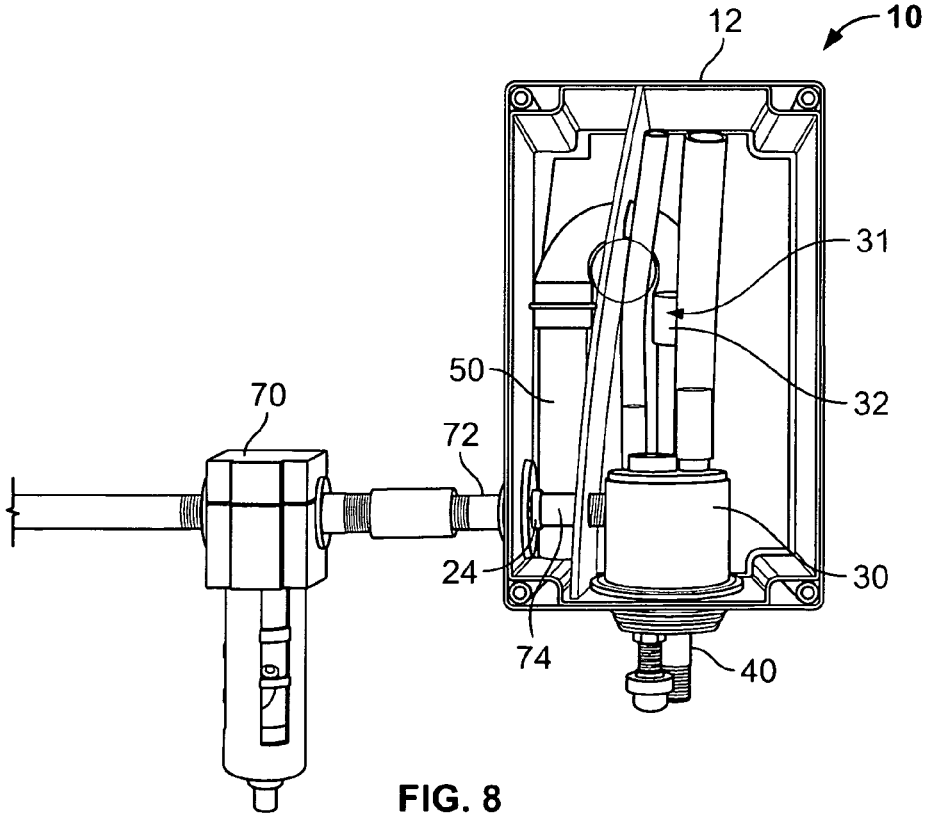
FIG. 8 illustrates a front perspective view of a cooling system connected to a compressed air filter according to an embodiment of the present invention.

FIG. 8 illustrates a front perspective view of the cooling system 10 connected to a compressed gas filter 70. The compressed gas filter 70 filters compressed gas, such as air, to the main heat conduction housing 30 through a delivery pipe 72. In an alternative arrangement, delivery pipe 72 is sealingly secured to a corresponding inlet pipe 74 that connects to the main heat conduction housing 30. The delivery pipe 72 and the inlet pipe 74 may be sealingly secured to one another, through, for example, a sealed threadable interface, proximate the gas inlet passage 24. Thus, compressed gas, such as air, may pass from the gas filter 70, through the delivery pipe 72 and into the inlet pipe 74, which, in turn provides a fluid path into the main heat conduction housing 30. The compressed gas passes into the vortex tube 31, including the hot pipe 32 and the cool gas delivery pipe 40, thereby producing cool gas that is passed through the cool gas delivery pipe 40. As such, the cooling system 10 may produce cooled gas through compressed air being supplied to the vortex tube.

As shown in FIG. 8, the inlet pipe 74, which delivers compressed air into the cooling system 10, is within the hot exhaust portion of the cabinet 12. An additional baffle may be positioned between the inlet pipe 74 and the porous plastic tubing 50 to segregate the hot exhaust that exits the plastic tubing 50 from the inlet pipe 74. Optionally, the plastic tubing 50 may be secured to a lateral wall of the cabinet 12 above the inlet pipe 74. In this case, an additional baffle may be positioned between the plastic tubing 50 and the inlet pipe 74 in order to segregate the hot exhaust from the compressed air delivered to the cooling system 10 through the inlet pipe 74. Also, alternatively, the inlet pipe 74 may connect to the main heat conduction housing 30 through the cool exhaust portion of the cabinet, instead of the hot exhaust portion. Various other configurations may be used to ensure that the hot exhaust air from the pipe 50 is not in close proximity to the compressed air being delivered to the cooling system 10 through the inlet pipe 74.

Figure 9:
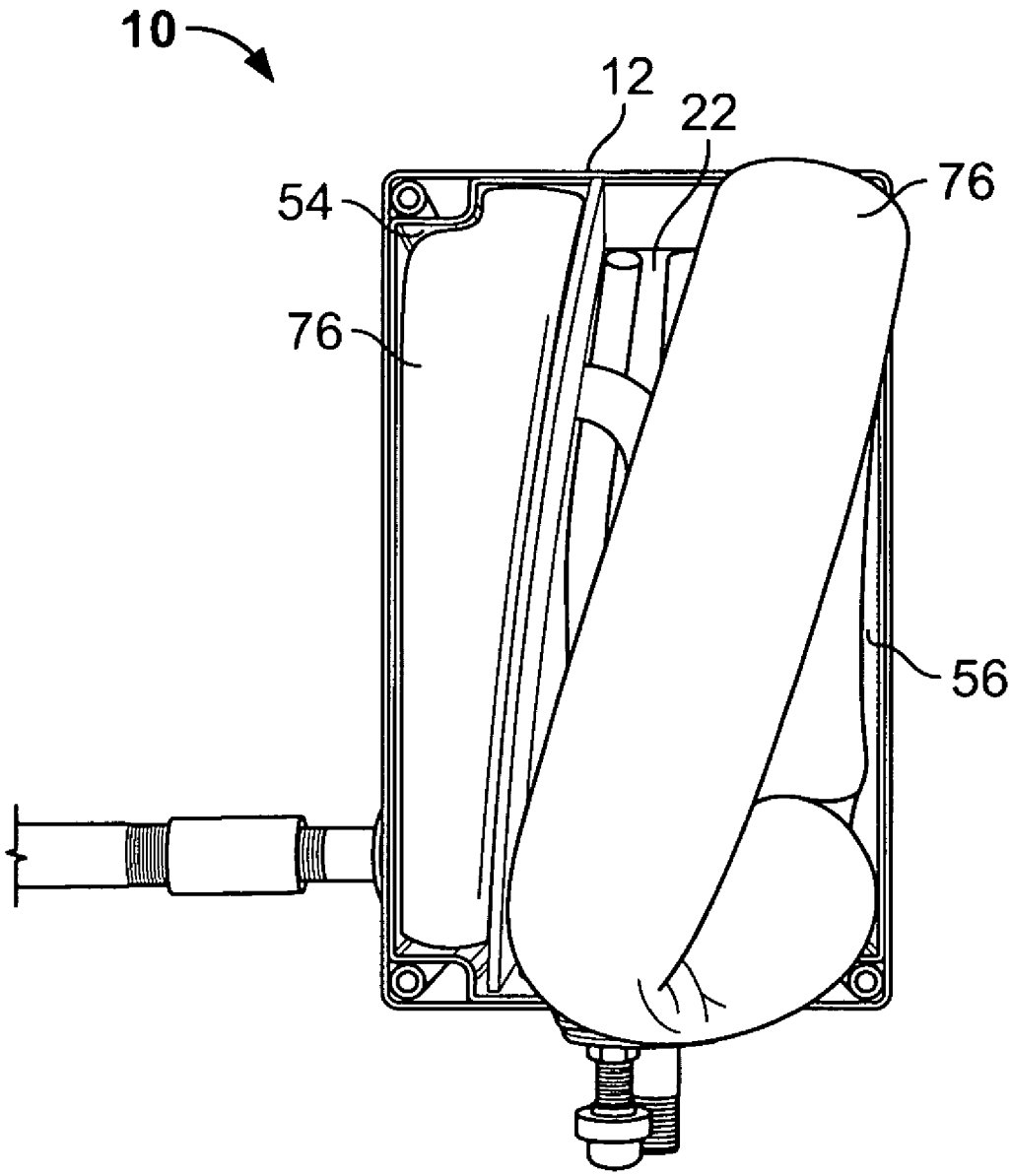
FIG. 9 illustrates a front perspective interior view of a cooling system with flexible dampening members according to an embodiment of the present invention.

FIG. 9 illustrates a front perspective interior view of the cooling system with a plurality of flexible dampening members 76. The flexible dampening members 76 may be flexible open cell foam rods. Each rod may have a diameter of approximately two inches. As shown in FIG. 9, one flexible dampening member 76 is folded and compressed into the hot exhaust area 54 of the venting chamber 22, while another dampening member 76 is folded and compressed into the cool air area 56. Additional dampening members 76 may be positioned within the venting chamber 22. Overall, the open cell foam, whether in the form of flexible rod-like dampening members 76, or sheets (such as cell foam sheet 60 shown in FIG. 5) may occupy a substantial portion of the venting chamber 22. For example, open cell foam may occupy approximately 90% of the space within the venting chamber 22. The dampening members 76 provide additional noise damping within the cooling system 10, while at the same time, allowing exhaust gas to flow therethrough. Alternatively, the dampening members 76 may be formed of porous rubber, plastic, or the like.

Figure 10:
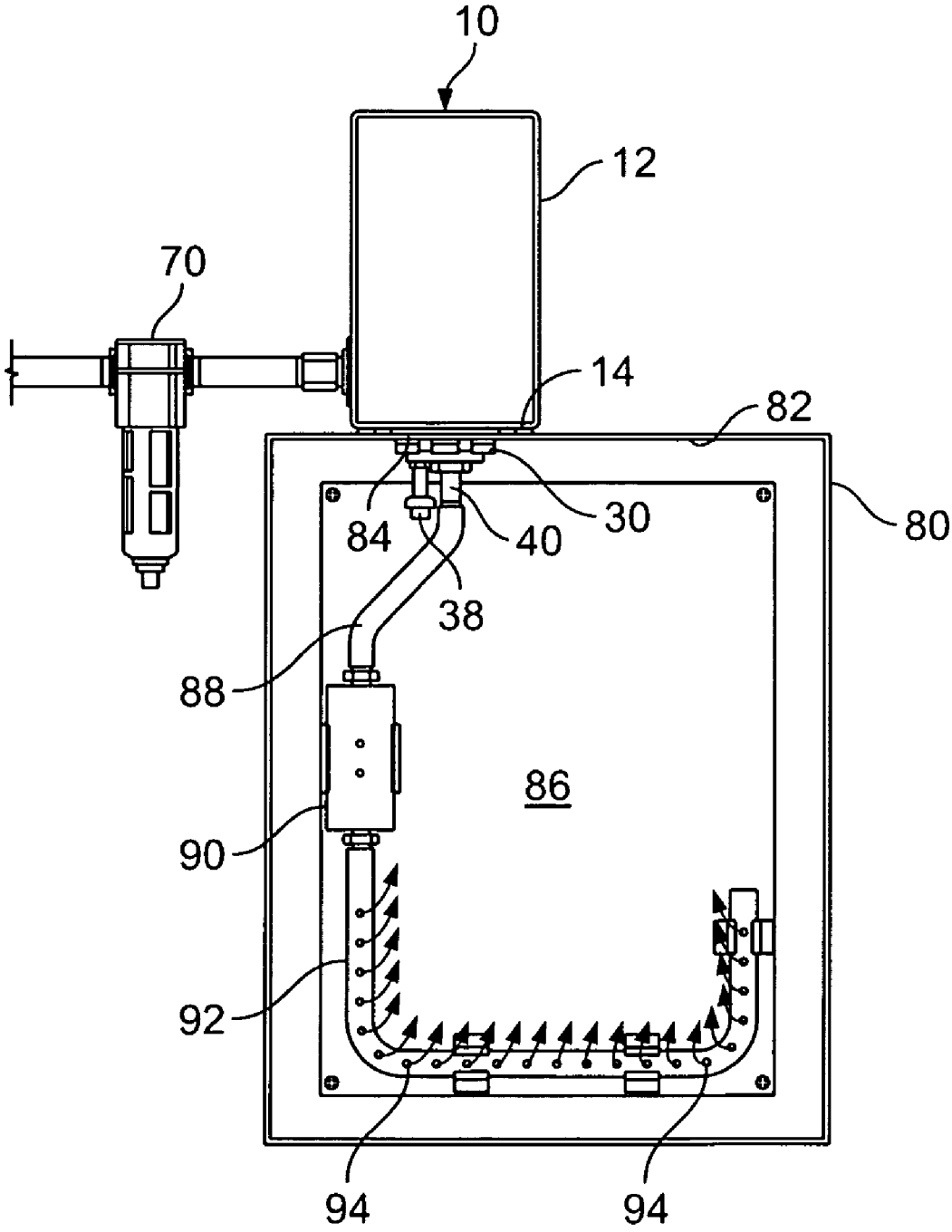
FIG. 10 illustrates a front elevational view of a cooling system connected to an enclosure according to an embodiment of the present invention.
Figure 11:
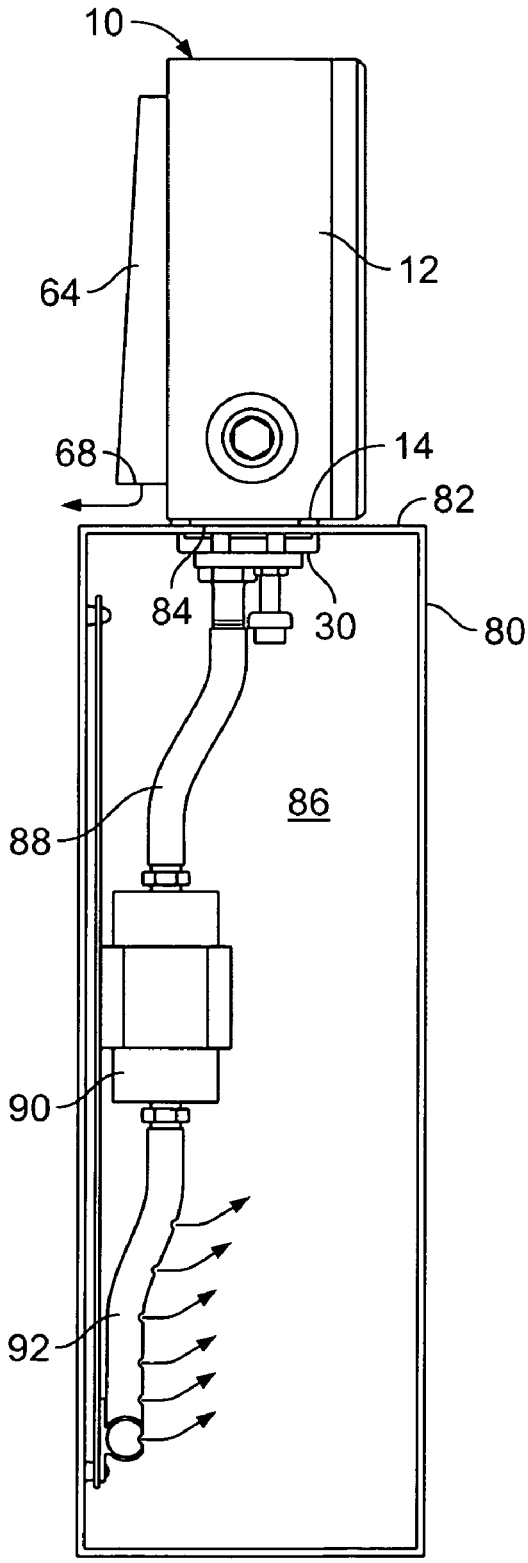
FIG. 11 illustrates a lateral elevational view of a cooling system connected to an enclosure according to an embodiment of the present invention.

FIGS. 10 and 11 illustrate a front elevational view and a lateral elevational view, respectively, of the cooling system 10 connected to an enclosure 80. The cabinet 12 mounts to the top of the enclosure 80 such that the base 14 is supported by a top surface 82 of the enclosure 80. A knockout hole 84 is formed through the top surface 82 of the enclosure 80, and a lower portion of the main heat conduction housing 30 is sealingly secured within the knockout hole 84. The thermostat 38 and the cool gas delivery pipe 40 extend into an interior chamber 86 of the enclosure 80. The vent holes 41 and 43 (shown in FIG. 3), and the bleed air hole 45 (shown in FIG. 3) are also exposed to the interior chamber 86.

Gas, such as air, is supplied to the main heat conduction housing 30 through the compressed gas system and the air filter 70. The main heat conduction housing 30 then produces cool gas through the vortex tube (which includes the hot pipe and the cool gas delivery pipe). A distal end of the cool gas delivery pipe 40 is connected to one end of a flexible tube 88 which provides a fluid path from the cool gas delivery pipe 40 to a muffler 90. A sealed tube 92 (which may also be a vinyl tube) having a plurality of passages 94 is connected to an opposite end of the muffler 90. Thus, cool gas may be delivered to the sealed tube 92 through the path defined from the cool gas delivery pipe 40, the flexible tube 88, and the muffler 90. The cool gas then passes into the interior chamber 86 of the enclosure 80 to cool internal components. The gas may then be vented back into the cooling system 10 through the vent holes 41 and 43 (shown in FIG. 3), and out of the cooling system 10, as described above. As the interior chamber 86 of the enclosure 80 is being cooled, exhaust and vented gases pass out of the cooling system 10 through the exhaust outlet 68 located at a lower end of the shroud 64. Optionally, the sealed tube 92 may be an open-ended tube without passages formed therethrough. In this case, the cold gas may pass through the open end of the tube.

Referring to FIGS. 1-11, the dampening sleeve 42 positioned around the hot pipe 32, the porous plastic tube 50, the dampening sheets 60, dampening members 76 and cold air muffler 90 all serve to dampen, diminish, absorb, or otherwise reduce noise created by the operation of the vortex tube 31 (including the hot pipe 32). Thus, the cooling system 10 produces less noise than prior vortex tube cooling devices.

Referring to FIGS. 3 and 11, the cooling system 10 is also capable of continually pressurizing and purging the enclosure 80, even when the vortex tube 31 is deactivated. One benefit that the compressed air driven vortex tube cooling system 10 has over conventional "Freon type" air conditioners is that the cooling system 10 blows the cooling air into the enclosure 80 under a slight positive pressure. Thus, the pressure within the enclosure 80 is slightly higher than the outside air pressure exerted into the outer surfaces of the enclosure 80. The pressure differential between the outside of the enclosure 80 and the interior of the enclosure 80 serves to ensure that contaminants do not infiltrate into the enclosure 80. In order to maintain this constant pressure differential (to keep the enclosure 80 clean), a source of compressed air (such as that supplied through the compressed gas filter 70) is connected to the bleed air hole 45 formed through the bottom of the main heat conduction housing 30. Thus, the bleed air hole 45 is in fluid communication with the compressed gas supply port. The end of the bleed air hole 45 may threadably retain a removable set screw to plug the hole if pressurization of the enclosure 80 is not desired. As such, there is no need to drill an additional hole in the enclosure 80 to provide a path for a source of pressurized air that maintains a pressure differential between the interior chamber 86 of the enclosure 80 and the outside of the enclosure 80 (in order to keep the interior of enclosure 80 clean). Instead, the bleed air hole 45 may be in fluid communication with a compressed air supply, thereby allowing air to be continually pumped into the enclosure 80, without operation of the main heat conduction housing 30. Thus, the enclosure 80 may remain clean even when the vortex tube 31 is not operating.

Figure 12:
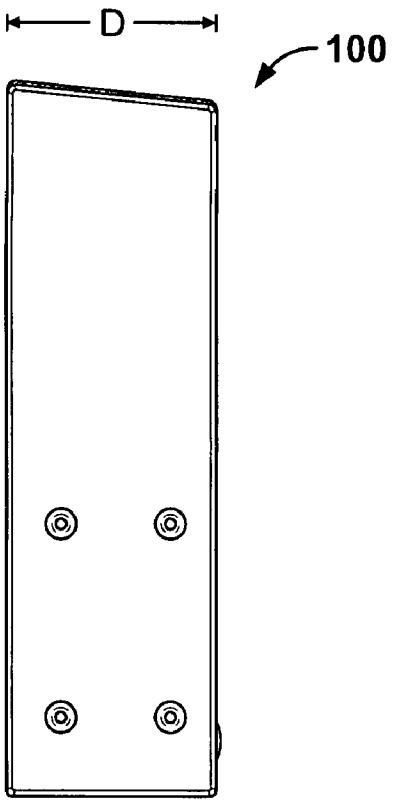
FIG. 12 illustrates a lateral view of a shroud according to an embodiment of the present invention.

FIG. 12 illustrates a lateral view of a shroud 100 according to an embodiment of the present invention. The shroud 100 has a greater lateral depth D than the shroud 64 (shown, for example, in FIG. 6).

Figure 13:
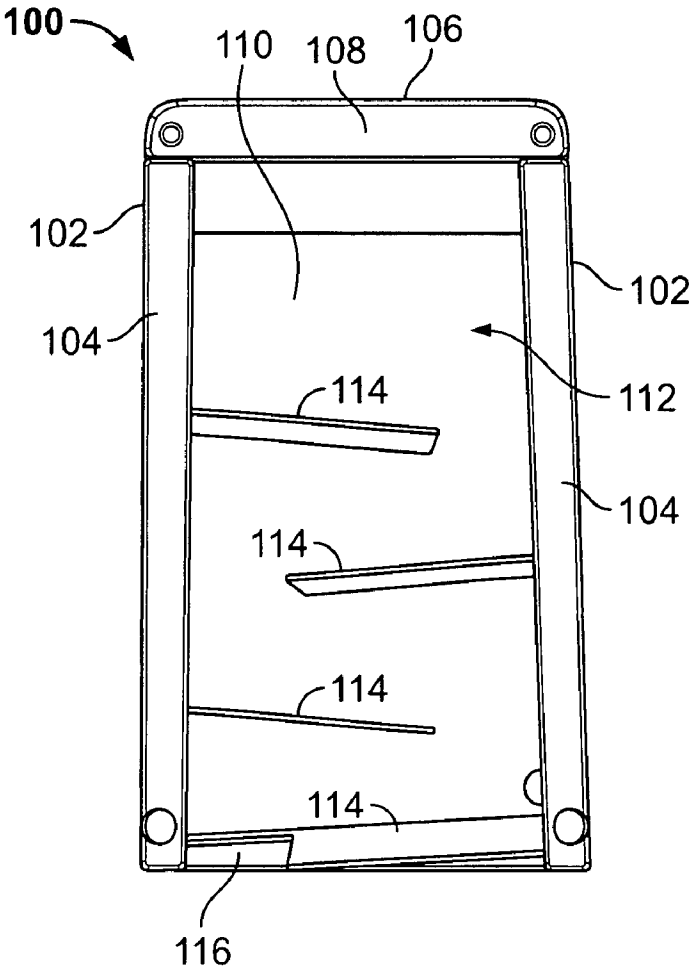
FIG. 13 illustrates an internal view of a shroud according to an embodiment of the present invention.

FIG. 13 illustrates an internal view of the shroud 100. The shroud 100 includes lateral walls 102 having mounting flanges or edges 104, a top wall 106, having a mounting flange or edge 108, and a cover 110. The lateral walls 102, the top wall 106, and the cover 110 define an exhaust chamber 112. The shroud 100 is configured to mount to the rear of the cabinet 12 (shown, for example, in FIGS. 1-11) similar to how the shroud 64 (shown, for example, in FIG. 6) mounts to the cabinet 12. For example, the shroud 100 is mounted so that mounting flanges 104 and 108 abut the rear wall of the cabinet 12.

A series of baffles 114 are positioned within the exhaust chamber 112. An exhaust outlet 116 is formed through the lower portion of the shroud 100, proximate a lower baffle 114. The baffles 114 are configured to prevent moisture from infiltrating the shroud 100. While four baffles 114 are shown, more or less baffles than those shown may be used with the shroud 100.

Thus, embodiments of the present invention provide a compact cooling system that is easy to install and produces low noise levels. Embodiments of the present invention provide a simple cooling system that produces cool air without the use of refrigerants. Additionally, embodiments of the present invention provide a vortex tube cooling system that may maintain a clean enclosure interior through air pressure differentials even when the cooling system is not operating in a cooling mode.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A cooling system configured to cool an interior of an enclosure, comprising:

a cabinet defining a venting chamber;

a vortex tube comprising (i) a hot pipe within said venting chamber, and (ii) a cool gas delivery pipe extending outwardly from said cabinet, said cool gas delivery pipe configured to deliver cold gas to the interior of the enclosure;

a dampening sleeve secured around at least a portion of said hot pipe, said dampening sleeve configured to dampen noise produced by said vortex tube; and a porous plastic tube connected to an outlet of said hot pipe through a flexible vinyl tube, wherein exhaust gas from said hot pipe is routed to said porous plastic tube through said flexible vinyl tube, wherein the exhaust gas passes through said porous plastic tube.

2. The cooling system of claim 1, wherein said dampening sleeve is formed of rubber.

3. The cooling system of claim 1, wherein said cabinet compnses:

a base integrally formed with a rear wall and lateral walls;

an upper wall integrally formed with said rear wall and said lateral walls, said venting chamber being defined by said base, said rear wall walls, said lateral walls, and said upper wall;

a cover over said venting chamber;

at least one dampening sheet lining at least a portion of at least one of said base, said rear wall, said lateral walls, and said upper wall, said at least one dampening sheet being configured to dampen noise produced by said vortex tube.

4. The cooling system of claim 3, wherein said at least one dampening sheet comprises open cell foam.

5. The cooling system of claim 3, further comprising at least one flexible dampening rod folded and compressed within said venting chamber.

6. The cooling system of claim 5, wherein said at least one flexible dampening rod comprises open cell foam.

7. The cooling system of claim 1, further comprising a thermostat extending outwardly from said cabinet, said thermostat configured to be positioned within the interior of the enclosure.

8. The cooling system of claim 1, further comprising at least one vent pipe secured within said cabinet, wherein said at least one vent pipe is configured to allow gas within the interior of the enclosure to vent into said venting chamber.

9. The cooling system of claim 8, further comprising at least one flexible open-ended tube secured to said at least one vent pipe, wherein said at least one flexible open-ended tube is configured to allow gas to vent from said at least one vent pipe through said at least one flexible tube.

10. The cooling system of claim 1, wherein said cabinet further comprises a venting opening configured to allow gas to vent out of said cabinet.

11. The cooling system of claim 1, further comprising a shroud secured to said cabinet over said venting opening, said shroud comprising an exhaust path, wherein exhaust gas passing through said venting opening passes through said exhaust path.

12. The cooling system of claim 11, wherein said shroud comprises at least one internal baffle configured to prevent liquid infiltration.

13. The cooling system of claim 1, further comprising a baffle disposed within said cabinet, said baffle segregating said venting chamber into a hot exhaust portion and a cool exhaust portion.

14. The cooling system of claim 1, further comprising a bleed air hole configured to be in fluid communication with the interior of the enclosure and a source of air, said bleed air hole operable to allow air to pass into the enclosure to maintain a pressure differential between the interior of the enclosure and an outside environment, wherein the pressure differential prevents debris from settling on the enclosure.

15. A cooling system configured to cool an interior of an enclosure, comprising:

a cabinet defining a venting chamber;

a vortex tube comprising (i) a hot pipe within said venting chamber, and (ii) a cool gas delivery pipe extending outwardly from said cabinet, said cool gas delivery pipe configured to deliver cold gas to the interior of the enclosure; and at least one dampening sheet lining at least a portion of said cabinet, said at least one dampening sheet being configured to dampen noise produced by said vortex tube; and a porous plastic tube connected to an outlet of said hot pipe through a flexible vinyl tube, wherein exhaust gas from said hot pipe is routed to said porous plastic tube through said flexible vinyl tube, wherein the exhaust gas passes through said porous plastic tube.

16. The cooling system of claim 15, further comprising a dampening sleeve secured around at least a portion of said hot pipe, said dampening sleeve configured to dampen noise produced by said vortex tube.

17. The cooling system of claim 16, wherein said dampening sleeve is formed of rubber.

18. The cooling system of claim 15, wherein said at least one dampening sheet comprises open cell foam.

19. The cooling system of claim 15, further comprising at least one flexible dampening rod pesitiened folded and compressed within said venting chamber.

20. The cooling system of claim 19, wherein said at least one flexible dampening rod comprises open cell foam.

21. The cooling system of claim 15, further comprising a vent pipe secured within said cabinet, wherein said vent pipe is configured to allow gas within the interior of the enclosure to vent into said venting chamber.

22. The cooling system of claim 21, further comprising a flexible open-ended tube secured to said vent pipe, wherein said flexible open-ended tube is configured to allow gas to vent from said vent pipe through said flexible tube.

23. The cooling system of claim 15, wherein said cabinet further comprises a venting opening configured to allow gas to vent out of said cabinet.

24. The cooling system of claim 15, further comprising a shroud secured to said cabinet over said venting opening, said shroud comprising an exhaust path, wherein exhaust gas passing through said venting opening passes through said exhaust path.

25. The cooling system of claim 24, wherein said shroud comprises at least one internal baffle configured to prevent liquid infiltration into said shroud.

26. The cooling system of claim 15, further comprising a baffle disposed within said cabinet, said baffle segregating said venting chamber into a hot exhaust portion and a cool exhaust portion.

27. The cooling system of claim 15, further comprising a bleed air hole configured to be in fluid communication with the interior of the enclosure and a source of air, said bleed air hole operable to allow air to pass into the enclosure to maintain a pressure differential between the interior of the enclosure and an outside environment, wherein the pressure differential prevents debris from settling on the enclosure.

28. A cooling system configured to cool an interior of an enclosure, comprising:

a cabinet defining a venting chamber; a vortex tube comprising (i) a hot pipe within said venting chamber, and (ii) a cool gas delivery pipe extending outwardly from said cabinet, said cool gas delivery pipe configured to deliver cold gas to the interior of the enclosure; and a bleed air hole configured to be in fluid communication with the interior of the enclosure and a source of air, said bleed air hole operable to allow air to pass into the enclosure to maintain a pressure differential between the interior of the enclosure and an outside environment, wherein the pressure differential prevents debris from settling on the enclosure even when said vortex tube is deactivated.

29. The cooling system of claim 28, comprising a porous plastic tube connected to an outlet of said hot pipe through a flexible vinyl tube, wherein exhaust gas from said hot pipe is routed to said porous plastic tube through said flexible vinyl tube, wherein the exhaust gas passes through said porous plastic tube.

* * * * *